US005664280A

United States Patent [19]

Tonsager

[11] Patent Number: 5,664,280

[45] Date of Patent: Sep. 9, 1997

[54] ADJUSTABLE COVE TROWEL

[76] Inventor: Wayne Tonsager, P.O. Box 1242, Lakeville, Minn. 55044

[21] Appl. No.: 685,980

[22] Filed: Jul. 22, 1996

[51] Int. Cl.[6] ..... B05C 17/10; E01C 19/12

[52] U.S. Cl. ..... 15/235.7; 15/235.8; 425/458

[58] Field of Search ..... 15/235.4, 235.7, 15/235.8; 425/87, 458

[56] References Cited

U.S. PATENT DOCUMENTS

| | | | |
|---|---|---|---|
| 109,073 | 11/1870 | Streeter | 15/235.8 |
| 398,781 | 2/1889 | Hovey . | |
| 684,576 | 10/1901 | Lucas . | |
| 1,370,060 | 3/1921 | Smith . | |
| 1,383,688 | 7/1921 | Word . | |
| 1,423,455 | 1/1922 | Rivers et al. . | |
| 1,691,777 | 11/1928 | Mayes | 15/235.4 |
| 1,831,988 | 11/1931 | Aldeen . | |
| 2,178,899 | 2/1939 | Shafer . | |
| 2,608,853 | 9/1952 | Schrepper . | |
| 2,795,349 | 6/1957 | Cawood . | |
| 3,373,458 | 3/1968 | Haivala | 15/235.8 |
| 4,669,970 | 6/1987 | Perry | 15/235.7 |
| 5,067,889 | 11/1991 | Humiston | 15/235.7 |
| 5,442,832 | 8/1995 | Tonsager | 15/235.8 |
| 5,544,384 | 8/1996 | Forselius | 15/235.8 |

FOREIGN PATENT DOCUMENTS

| | | |
|---|---|---|
| 1241176 | 7/1971 | United Kingdom . |
| 1563651 | 3/1980 | United Kingdom . |

*Primary Examiner*—David Scherbel
*Assistant Examiner*—Randall Chin
*Attorney, Agent, or Firm*—Haugen and Nikolai P.A.

[57] ABSTRACT

An adjustable trowel to facilitate formation of a coved corner between two structural panels comprises a blade having two laterally spaced trapezoidal-shaped, rigid wing segments integrally joined along parallel inside edges by an intermediate segment which is of rectangular shape and of reduced thickness compared to the rigid wing segments to allow flexure in the zone occupied by the intermediate segment. Affixed to each of the rigid wing segments are handle mounting brackets that overlap one another and include an arcuate slot therein for receiving a handle mounting bolt therethrough. By tightening the bolt, the wings are held at a selected angle to one another and with the intermediate segment assuming a desired curvature.

10 Claims, 2 Drawing Sheets

ADJUSTABLE COVE TROWEL

BACKGROUND OF THE INVENTION

I. Field of the Invention

This invention relates generally to a tool for applying joint compound or plaster to a joint between abutting sheetrock panels to create a cove corner, and more particularly an adjustable trowel having a blade with two planar wing-like segments joined by a smoothly rounded arcuate contour having an adjustable radius over a predetermined range.

II. Discussion of the Prior Art

An architecturally pleasing look to a room in a residential or commercial building can be achieved by providing a coved ceiling line or a rounded transition in the inside corner of two abutting wall surfaces. While a cove ceiling line is often realized using special moldings, an alternative approach at creating a rounded corner is to apply so-called "joint compound" to the intersection of the wall panels or wall and ceiling panels in a series of sequential coats to create the desired cove effect.

At present, the plasterer must work with a flat trowel and as each layer is applied, build up the rounded inside corner by deftly manipulating the trowel-in an attempt to generate a uniform curvature over the entire length of the corner joint. This requires considerable skill.

There are also incidences in building construction where the corner is at an angle other than 90°. For example, with vaulted ceilings or angled walls, two panels may come together at an angle anywhere between, for example, 75° and 150°. Creating a coved ceiling or corner for a wide variety of possible angles, taxes even the most accomplished plasterer or sheetrock finisher.

Therefore, a need exists for a tool that will facilitate the forming of coved corners or joints between adjacent walls or between walls and ceilings whether the angle between the, same is 90° or an angle other than 90°.

SUMMARY OF THE INVENTION

In accordance with my invention, I provide an adjustable trowel for creating a coved corner between abutting wall and/or ceiling panels. It comprises a flexible sheet of material having a memory property tending to maintain said sheet in a planar configuration. The sheet is cut or stamped to include two trapezoidal-shaped wings spaced apart from one another and each being integrally joined by an intermediate generally rectangular segment. Two generally rigid plates shaped to be congruent to the trapezoidal segments of the sheet are affixed to the flexible sheet with a predetermined spacing between the inner side edges of the two plates leaving the central rectangular segment unreinforced. Fastened to the generally rigid trapezoidal-shaped plates and extending perpendicularly therefrom are handle mounting brackets to which a handle is secured. By attaching the handle to the handle mounting brackets, the first and second rigid plates can be set in a non-coplanar relationship and with the rectangular segment of the flexible sheet smoothly rounded. The sheet may comprise a variety of metals or plastics, but stainless steel is perhaps preferred because of its resistance to abrasion and its non-rusting characteristics.

DESCRIPTION OF THE DRAWINGS

The foregoing features and advantages of the invention will become apparent to those skilled in the art from the following detailed description of a preferred embodiment, especially when considered in conjunction with the accompanying drawings in which.

DESCRIPTION OF THE PREFERRED EMBODIMENT

Figure 1:
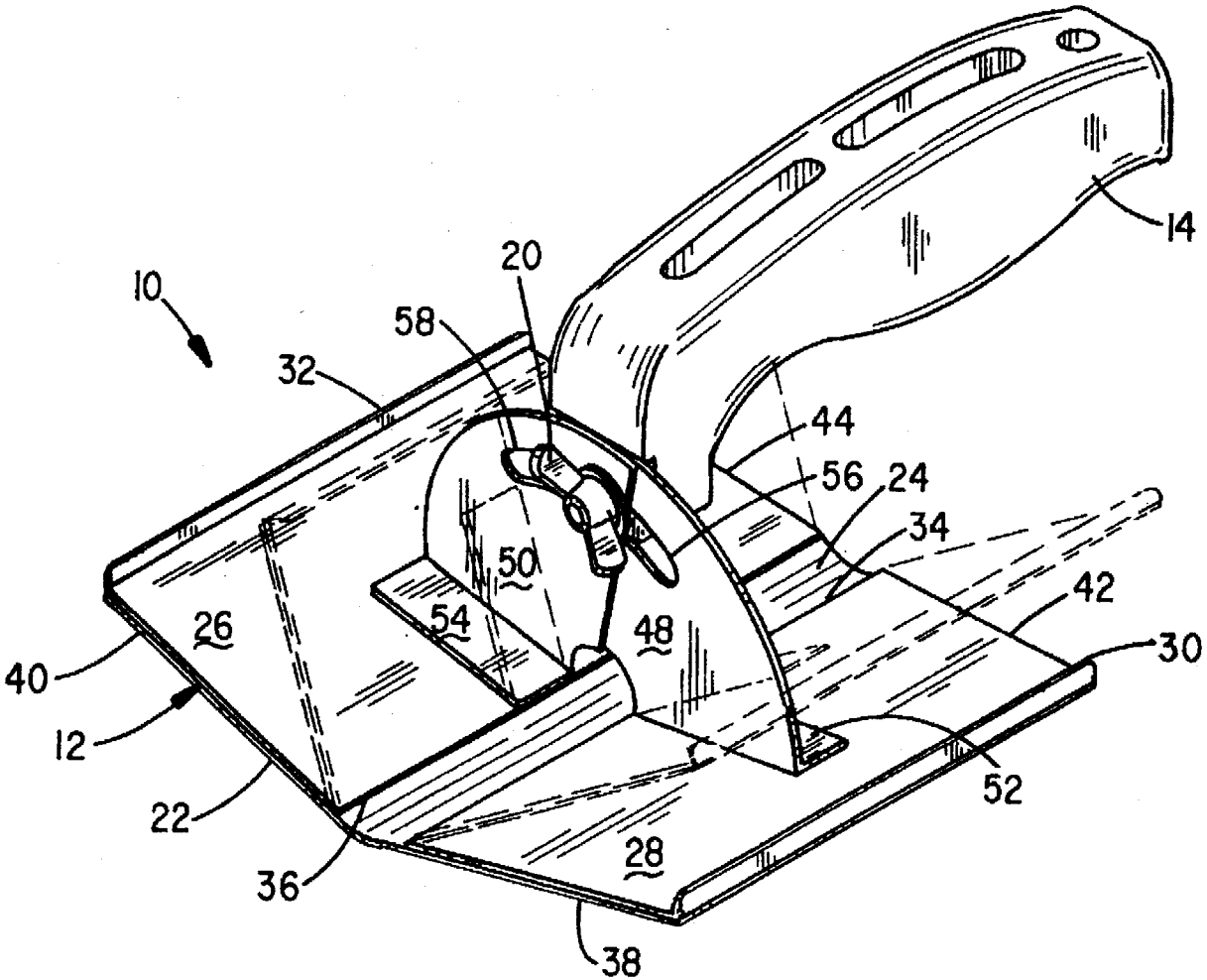
FIG. 1 is a perspective view of the adjustable trowel constructed in accordance with the present invention.
Figure 2:
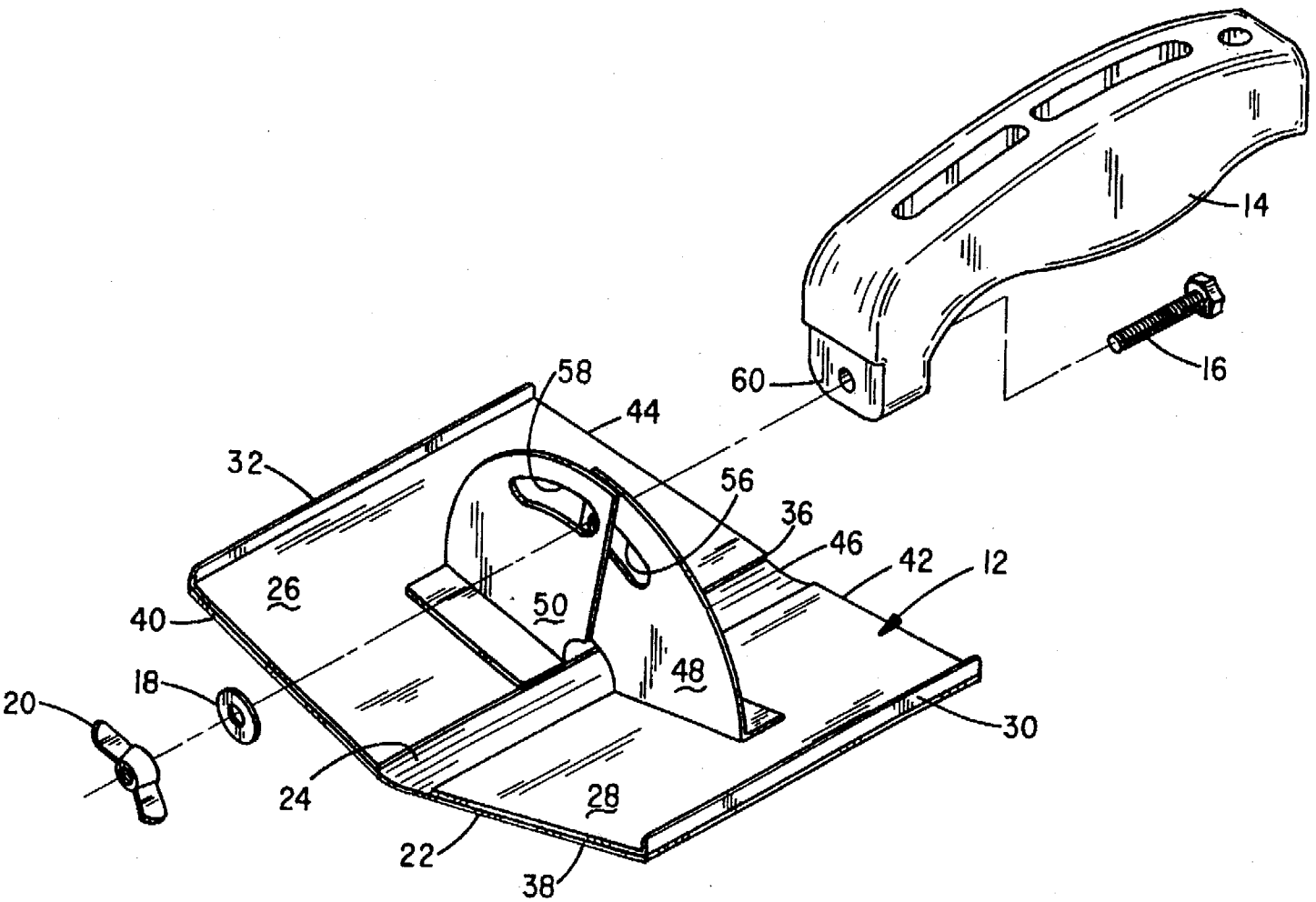
FIG. 2 is an exploded view of the adjustable trowel of FIG. 1.

Referring to the drawings, there is indicated generally by numeral 10 an adjustable trowel constructed in accordance with the present invention. It is seen to comprise a blade assembly 12 and a handle 14 that is adapted to be secured to the blade assembly by a bolt 16, a washer 18 and a wing nut 20.

The blade assembly comprises an underlying continuous layer 22 of a flexible material exhibiting a memory property tending to maintain that underlying layer in a planar configuration. The underlying layer may be one of a variety of metals or plastics but a stainless steel sheet approximately 0.008 inches in thickness is preferred. The underlying layer 22 may be thought of as comprising a pair of wings, each having the shape of a trapezoid, the two wings being interconnected by a central, generally rectangular section 24. Affixed to the upper surface of the underlying, continuous flexible sheet 22 are first and second generally rigid plates 26 and 28 which have the same dimensions and shape as the trapezoidal-shaped wing segments of the underlying sheet 22 and are generally congruent thereto when the plates 26 and 28 are laminated to the flexible sheet 22, except that the opposed side edge portions of the plates 26 and 28 are bent out of the plane of the plates at an angle of about 90°. That is to say, the outer edges 30 and 32 are parallel to the inner edges 34 and 36, but the outer edges 30 and 32 are bent at about a 90° angle to the plane of the plates 26 and 28. This bent portion adds rigidity and inhibits undue flexing of the composite trowel blade.

The inner edges 34 and 36 of the rigid plates 26 and 28 are spaced apart from one another allowing the central zone 24 of the underlying continuous sheet 22 to flex. The underlying sheet 22 in the central zone 24 is smoothly rounded at 46 such that the front edges 38 and 40 and the rear edges 42 and 44 of the sheet 22 are tangent to the curved center section.

With no limitation intended, a prototype was constructed in which the upper, generally rigid trapezoid-shaped plates 26 and 28 were each 0.020 inches thick and measured 4½ inches along edges 30 and 32 and 5⅜ inches along edges 34 and 36. The distance between edges 32 and 36 and between edges 30 and 34 was 2¼ inches. The inner edges 34 and 36 were spaced from one another by approximately 1 inch. This prototype was determined to be highly effective in creating a coved joint between adjacent sheetrock panels.

The generally rigid trapezoidal pieces 26 and 28 are preferably bonded to the upper surface of the underlying sheet 22 by a suitable adhesive. However, other modes of attachment will suggest themselves to those skilled in the Spot-welded or otherwise structurally bonded to the exposed upper surface of the rigid trapezoidal segments 26 and 28 are handle mounting brackets 48 and 50. Each comprises a circular segment of approximately 90° arc and each having integrally formed foot members 52 and 54 bent at an angle of 90° to the plane of the arcuate segment. The feet 52 and 54 are spot-welded or otherwise affixed to the plates 28 and 26, respectively, and each of the handle mounting bracket members includes an arcuate slot as at 56 and 58. When the blade assembly 12 is flexed in the zone 24 between the rigid plates 26 and 28, the arcuate slots 56 and 58 overlap one another allowing the bolt 16 to pass through a bore 60 formed in the handle 14 and through the aligned slots. Now, when the wing nut 20 is tightened, the handle is secured to the handle mounting brackets with the two mounting bracket member halves being clamped to establish a desired angle between the planar wing segments defined by the reinforcing plates 26 and 28. The angle can be set at an adjustable value in the range of between about 75° and 150°.

OPERATION

In use, to create a rounded cove joint between adjacent wall or wall and ceiling panels, the workman will adjust the angle setting so that the edges 38 and 40 will approximate the angle between the panels whose joint is to be plastered. With a quantity of wet joint compound or plaster applied along the joint being treated, the workman will draw the trowel in a rearward direction with the handle tipped slightly back and away-from the joint between the intersecting panels to thereby create a smooths rounded arc of plaster between the adjacent panels. To create the desired cove effect, the plaster or joint compound may be applied in several steps or coats with drying taking place between each individual coat. As the curvature builds up, the angle of flex between the blade members may be adjusted accordingly by simply loosening the handle wing nut 20, flexing the blade in the zone 24 to the desired angle and then retightening the wing nut. The adjustability of the angle between the planar segments is illustrated in the perspective view of FIG. 1 by the superimposed ghost lines.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For example, rather than laminating the plates 26 and 28 to an underlying sheet 22, one can obtain the same result by starting with a sheet like 22 of greater thickness and removing material in rectangular center zone 24 to reduce the thickness and facilitate the smooth rounded bending thereof. The rectangular central zone 24 is of a constant lesser thickness dimension than the thickness of sheet 22.

What is claimed is:

1. An adjustable trowel for creating a coved corner between abutting wall board panels, comprising:

(a) a relatively flexible sheet of material having a memory property tending to maintain said sheet in a planar configuration;

(b) first and second relatively rigid plates having inner and outer side edges, said plates being affixed to the flexible sheet with a predetermined spacing between said inner side edges of the first and second plates;

(c) handle mounting brackets fastened to said first and second relatively rigid plates and extending perpendicularly therefrom;

(d) a handle; and (e) means for securing the handle to the handle-mounting brackets such that the first and second relatively rigid plates are held in a non-coplanar relationship and said flexible sheet is arcuately bent in the predetermined spacing.

2. The adjustable trowel as in claim 1 wherein the flexible sheet is continuous and comprises two trapezoidal-shaped wing segments interconnected to one another by a generally rectangular center section and the first and second relatively rigid plates are congruent to the trapezoidal-shaped wing segments and prevent bending of the wing segments except in the rectangular center section.

3. The adjustable trowel as in claim 2 wherein said flexible sheet is stainless steel of a predetermined thickness and the first and second plates are stainless steel having a thickness greater than the predetermined thickness of the flexible sheet.

4. The adjustable trowel as in claim 2 wherein the first and second plates are adhesively bonded to the flexible sheet.

5. The adjustable trowel as in claim 1 wherein the first and second plates have the outer side edges bent out of a plane parallel to the flexible sheet.

6. The adjustable trowel as in claim 1 wherein the handle mounting brackets include:

a handle mounting bolt;

an arcuate slot for receiving the handle mounting bolt therethrough; and a nut on the handle mounting bolt for securing the handle to the handle mounting brackets with a predetermined angle between planes defined by the first and second plates.

7. An adjustable trowel for creating a coved corner between abutting construction panels, comprising:

a) a generally rigid sheet of material of a predetermined thickness over a majority of its surface but having a rectangular central zone of a predetermined width dimension, the rectangular central zone being of a constant lesser thickness dimension than the predetermined thickness;

(b) handle brackets affixed to the generally rigid sheet and extending perpendicuiarly to the sheet to span the central zone;

(c) a handle; and (d) means for attaching the handle to the brackets to clamp the brackets with a predetermined arc imparted to the sheet in the central zone.

8. The adjustable trowel as in claim 7 wherein the sheet is plastic.

9. The adjustable trowel as in claim 7 wherein the sheet is stainless steel.

10. The adjustable trowel as in claim 7 wherein the generally rigid sheet of a predetermined thickness has the shape in a plan view thereof of a pair of trapezoids joined together along corresponding major bases of said pair of trapezoids by the central zone of lesser thickness.

* * * * *